United States Patent [19]

Klygis et al.

[11] 4,109,787

[45] Aug. 29, 1978

[54] MULTIPACKAGE AND CARRIER DEVICE

[75] Inventors: Mindaugas Julius Klygis, Barrington; Robert Charles Olsen, Streamwood, both of Ill.

[73] Assignee: Illinois Tool Works Inc., Chicago, Ill.

[21] Appl. No.: 782,275

[22] Filed: Mar. 28, 1977

Related U.S. Application Data

[63] Continuation-in-part of Ser. No. 602,619, Aug. 11, 1975, abandoned.

[51] Int. Cl.[2] ..... A45C 11/00

[52] U.S. Cl. ..... 206/150; 294/87.2; 224/45 AA

[58] Field of Search ..... 224/45 A, 45 AA; 294/87.2, 87.22; 206/150

[56] References Cited

U.S. PATENT DOCUMENTS

| | | | |
|---|---|---|---|
| 2,427,838 | 9/1947 | Cox | 224/45 AA |
| 2,604,354 | 7/1952 | Gray | 224/45 AA |
| 2,650,128 | 8/1953 | Failor | 294/87.2 |
| 3,325,004 | 6/1967 | Wanderer | 206/150 |
| 3,860,112 | 1/1975 | Klygis | 294/87.2 |
| 3,874,502 | 4/1975 | Weaver | 206/150 |
| 3,946,862 | 3/1976 | Klygis et al. | 294/87.2 |

*Primary Examiner*—Trygve M. Blix
*Assistant Examiner*—Kenneth Noland
*Attorney, Agent, or Firm*—Edward L. Benno; Robert W. Beart

[57] ABSTRACT

A multiple container package for consumer direction with filled containers and for return direction with empty containers; the containers, such as cans or bottles, being of the type having a reduced generally cylindrical neck portion with an outward shoulder or bead formation below the neck opening; and including a resilient and deformable plastic carrier sheet positioning the containers in the packaged array by means of bands presenting apertures in the carrier sheet receiving the neck portions and with edges of the bands engaging beneath the shoulder or bead formations, and with tabs projecting laterally outwardly from opposite edges of the carrier sheet adjacent the apertures so that upon association of the neck portions with the band apertures, the tabs and carrier material along these outer edges will assume the curvature of the container neck portions with minimum stretching and tendency toward taking a set during storage and shelf life of the filled containers and with the tabs to deflect sharply downwardly into snug engagement with adjacent surfaces of the neck portions, and leaving sufficient resiliency in the material at least along the outer edges of the apertures enabling adequate support of an array of empty containers associated with the carrier sheet for return thereof to source for sterilizing, re-filling and re-closing of the returned containers.

8 Claims, 16 Drawing Figures

MULTIPACKAGE AND CARRIER DEVICE

BACKGROUND OF THE INVENTION

This application is a continuation-in-part application of the co-pending application of the same inventors filed Aug. 11, 1975, and carrying the Ser. No. 602,619 now abandoned.

This invention is concerned with packages of bottles and like containers and carriers therefor. Such bottles or like containers are conventionally of the type including a generally cylindrical reduced neck portion diverging to a larger body portion. The neck openings may be closed in various ways, as by screw caps or pressed-on caps, and in these forms, the lower edge of the cap presents an annular shoulder which may be engaged by the edges of apertures in certain forms of carriers. With pressed-on caps, the neck finish includes an outward end bead or shoulder for engagement therewith. In other forms of bottles and like containers, there is often provided an outward annular bead or shoulder below the neck finish and this bead or shoulder may be engaged by the aperture edges for support in certain types of carriers. These types of bottles or like containers may be assembled in packages by various forms of carriers, such as those made from sheet plastic material, cardboard and the like, which may be in flat sheet form or folded to tubular and other shapes with upper neck-receiving apertures in supporting engagement with the neck shoulder means as provided by the depending skirt edges of caps or by one of the neck beads as the case may be. The containers may be variously arranged in package form with the carrier as in the parallel rows of a six pack or the like, or in linear array, or even circular. In most of these packages, the bottles or other containers are of the no-deposit, non-return type so that they are discarded after use along with the carriers. While certain carriers of the folded or generally tubular shape may be used to return empty containers to source for re-filling, the flat plastic sheet carriers have not generally been designed for return of deposit bottles intended for re-use. With disposal of non-return containers and carriers becoming an increasing environmental concern, the tendency toward using return bottles is increasing, particularly in the beverage field. Where such flat plastic sheet carriers have been used for return of so-called deposit bottles, the initial stretching of the material around the apertures often results in that material taking a sufficient set such that there is insufficient resiliency remaining when re-associated with empty bottles to provide a sufficiently firm and stable package for safe return of the empty bottles to source for sterilizing, re-filling and re-closing for other trips in the consumer direction. This setting, or partial setting, may result from extended transport, storage and shelf life of the package of filled bottles as well as the further stretching and often tearing caused by the release of the filled bottles from the carrier for dispensing the contents.

SUMMARY OF THE INVENTION

According to the present invention, the carrier is particularly designed for packaging the bottles or like containers in parallel rows such as a six pack but the number of included containers may vary. The carrier is a one-piece sheet of resilient, deformable plastic material such as polyethylene or similar material of selected density for the intended use, which is stamped from a flat sheet blank to provide spaced apertures along the sides to receive the container neck portions in supported package position; to provide tabs projecting laterally outwardly from the sides of the carrier sheet in transverse alignment with the neck receiving apertures; and a central handle member for convenient carrying of the package. The cut out scrap material may be recycled.

An object of the invention is to provide a carrier of the above type which is adapted for packaging filled bottles or like containers for retail consumer outlets and for packaging the same or similar empty bottles or like containers for return to source for a re-filling process.

Another object of the invention is to provide a carrier of the above type with neck-receiving apertures variously shaped to withstand association and removal of filled containers relative thereto and subsequent association of empty containers therewith in stable package form for return to source for re-filling.

A further object of the invention is to provide a carrier and package of the above type wherein the carrier sheet is provided with tabs extending laterally outwardly of the sides of the sheet from an adjacent edge of a neck-receiving aperture with the tabs assisting in removal of filled containers from the package and subsequently assisting in re-associating empty containers with the carrier in stable package form for return to source for re-filling, with the tabs deflected downwardly into substantial surface contact with adjacent neck portions.

The above and other objects of the invention will in part be obvious and will be hereinafter more fully pointed out in the detail description of the accompanying drawings in which, FIG. 1 is a plan view of the carrier blank;

DETAILED DESCRIPTION OF THE PREFERRED EMBODIMENTS

Figure 1:
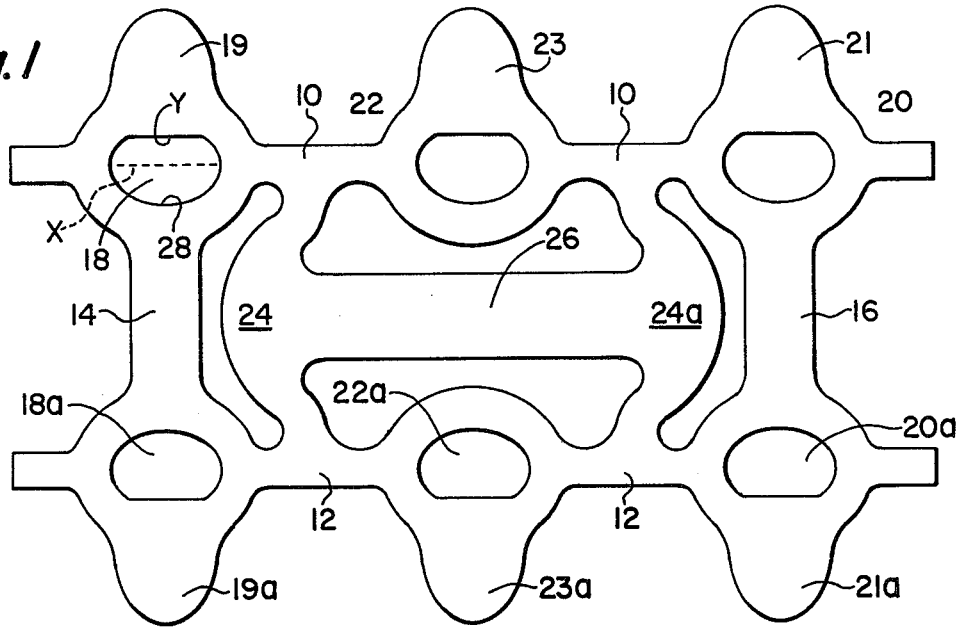

Referring to the accompanying drawings, and particularly FIG. 1 at this time, one form of carrier blank is shown before packaging. The blank includes side strap portions 10, 12 joined adjacent the ends thereof by transverse webs 14, 16. At the junction areas between the web 14 and the side strap elements 10, 12, there are provided apertures 18, 18*a* in mirror image and similar apertures 20, 20*a* are provided at the junction areas between the transverse web 16 and the strap elements 10, 12. Intermediate the ends of the carrier sheet, there are provided similar apertures 22, 22*a* in mirror image. From the outer edges of each of the apertures 18, 18*a*, 20, 20*a*, 22, 22*a*, tabs 19, 19*a*, 21, 21*a*, 23, 23*a* respectively project lateral outwardly of the side of these carrier sheets and these tabs are of generally triangular shape but with curvilinear outline. In the central area of the carrier sheet, certain portions are cut away to provide inner transverse webs 24, 24*a* with endwise outwardly convex edges and joined centrally by a handle strap 26 which will operate to project above the tops of the containers, when packaged, in the manner of Wanderer U.S. Pat. No. 3,269,530.

Figure 6:
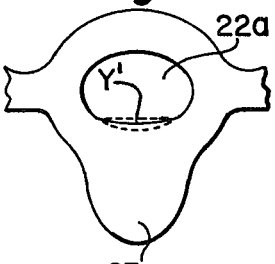
FIG. 6 is a fragmentary plan view showing a neck-receiving aperture with the tab adjacent edge of slight curvature.

The apertures for receiving the neck portions of the containers are identical but in mirror image along the sides of the carrier sheet so that the description of the shape of one will suffice. The opening or aperture 18 is generally elliptical throughout the major portion of the peripheral extent thereof to present a major axis X extending lengthwise of the carrier sheet with the curvature of edge 28 being continuous inwardly of the axis and toward the web 14. This curvature continues outwardly of the axis but then terminates in an outer edge Y from which the tab 19 projects outwardly. This outer edge Y is shorter than the major axis X of the aperture and is illustrated as being in straight line parrellelism with the major axis though it may be slightly curved in either direction relative thereto as shown in FIG. 6. Thus, each of the tabs projects outwardly from the edge Y of a corresponding aperture and away from corresponding sides of the carrier sheet. The bottles in the parallel rows are of the type having a body portion 32, 32*a* gradually reduced toward a reduced neck portion 33, 33*a* with an outward bead or shoulder formation 34, 34*a* below the skirts of the caps 36, 36*a*. As previously indicated, such caps will interengage with an upper bead (not shown) around the neck finish at the top of the neck portion of such bottle.

Figure 2:
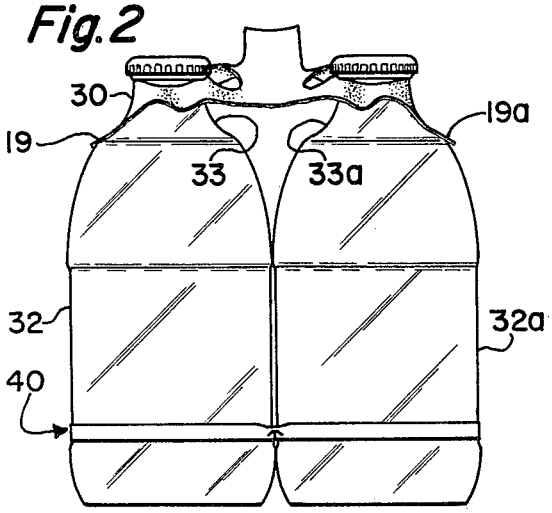
FIG. 2 is an end view of the carrier associated with bottles in parallel rows.
Figure 4:
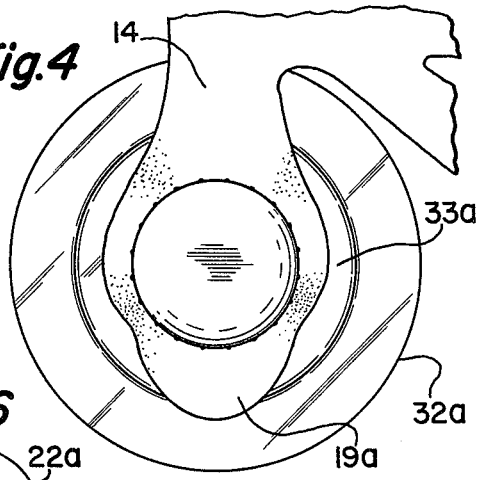
FIG. 4 is a top plan view of FIG. 5.
Figure 3:
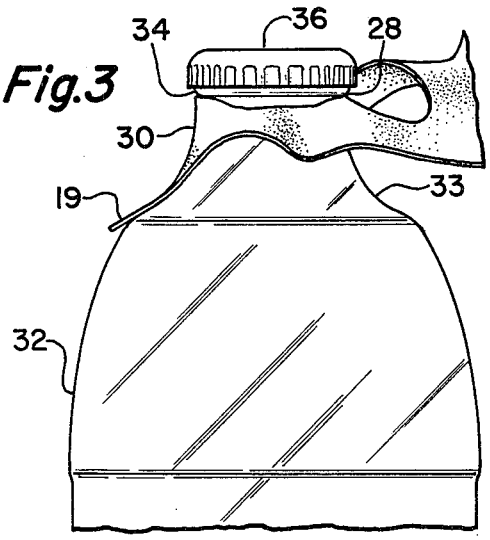
FIG. 3 is an enlarged fragmentary end view of the end left hand bottle in the package of FIG. 2.
Figure 5:
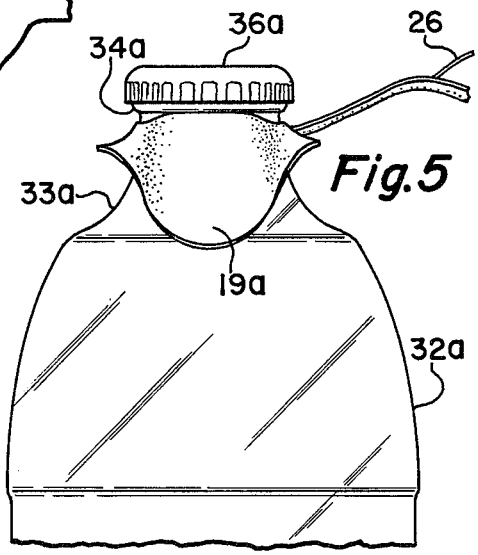
FIG. 5 is an enlarged fragmentary side view of the end right hand bottle in the package of FIG. 2.

The groups of filled bottles are associated with a carrier in automatic assembling machines causing the capped bottle neck portions and the neck-receiving apertures in each carrier sheet to be relatively telescoped. Also, an apertured plastic sheet 40 may be associated with lower portions of the bottle body portions for adding stability to each package and spacing the bottle body portions from one another. Such an apertured sheet may be of the general type shown in Poupitch U.S. Pat. No. 2,874,835. Association of the neck portions of the containers with the carrier sheet apertures will result in a re-shaping of these apertures by shortening the extent of the major axis X. The curved edge 28 of each aperture will be stretched to extend slightly upwardly to engage beneath a cap skirt, or as illustrated, beneath the bead formation 34. In turn, the edge Y of each aperture will assume a more pronounced vertical position, as at 30, beneath a cap skirt, or as illustrated, beneath a bead formation 34. In assuming this position, the portion 30 of the carrier sheet material will be contoured to complement the curvature of the adjacent underlying surface of a container neck portion and the associated tab will be deflected sharply downwardly to snug the underlying surface areas of the associated neck portions as shown particularly in FIGS. 2 and 3. This curving of the material along the aperture edge Y, as indicated at 30, will be with minimum stretching of the material so as to guard against its taking a permanent set during storage and shelf life of the package of filled containers, thus preserving residual resiliency of the material at least in this area for subsequent use of the carrier sheet in returning empty containers for re-filling.

Upon retail sale of the packages of filled containers, an individual container may be removed from the package by lifting a tab to stretch the portion 30 out of engagement with the cap skirt or bead formation, as the case may be, and to free the same from the carrier sheet, and thereafter pulling the bottle from the lower retainer 40. As previously indicated, it is contemplated from the carrier sheet be used for returning the deposit and return of now empty bottles to the retail outlet from which packaged empty bottles may be returned to source for sterilizing, re-filling and re-capping for another trip in the consumer direction. For this purpose, the empty bottles may be conveniently re-associated with a carrier sheet by pulling each tab downwardly to stretch each encircling band portion downwardly over the neck of an associated bottle to a position engaged beneath the bead at the finish of the neck or the bead formation 34 as illustrated. Even if a partial set has been taken by the encircling band portions, sufficient resiliency remains at least in the portion 30 to provide a stable package of empty bottles for return. In such reassembly, the tabs will again be deflected downwardly into surface engagement with the neck portions of the empty bottles with sufficiently snug resilient engagement to tend to hold the body portions of the bottles together in stable relationship in the absence of lower carrier 40.

It will be seen that the tabs extend longitudinally along the entire extent and beyond the ends of the outer edges Y and transversely outwardly a distance substantially greater than the width of the band portions of carrier material surrounding and defining the apertures, thus adding substantial carrier blank material to minimize stretching and resultant tearing in this area and confine maximum stretching to the remaining inner portions of the bands. This same control of the differential stretching of the band portions will be true of the modified forms or shapes of apertures in the modifications to be described hereinafter where the tabs extend longitudinally along a major portion of the longitudinal extent of the adjacent apertures or outer edges Y, if not beyond the ends thereof. The band portions present uninterrupted inner edges with the outer edges interrupted by connections with the webs 14, 16 and straps 10, 12 and the tabs. Since the webs and straps are relatively taut in the package, maximum stretching of the band edges occurs therealong and along portions of the bands between adjacent straps and webs.

Figure 7:
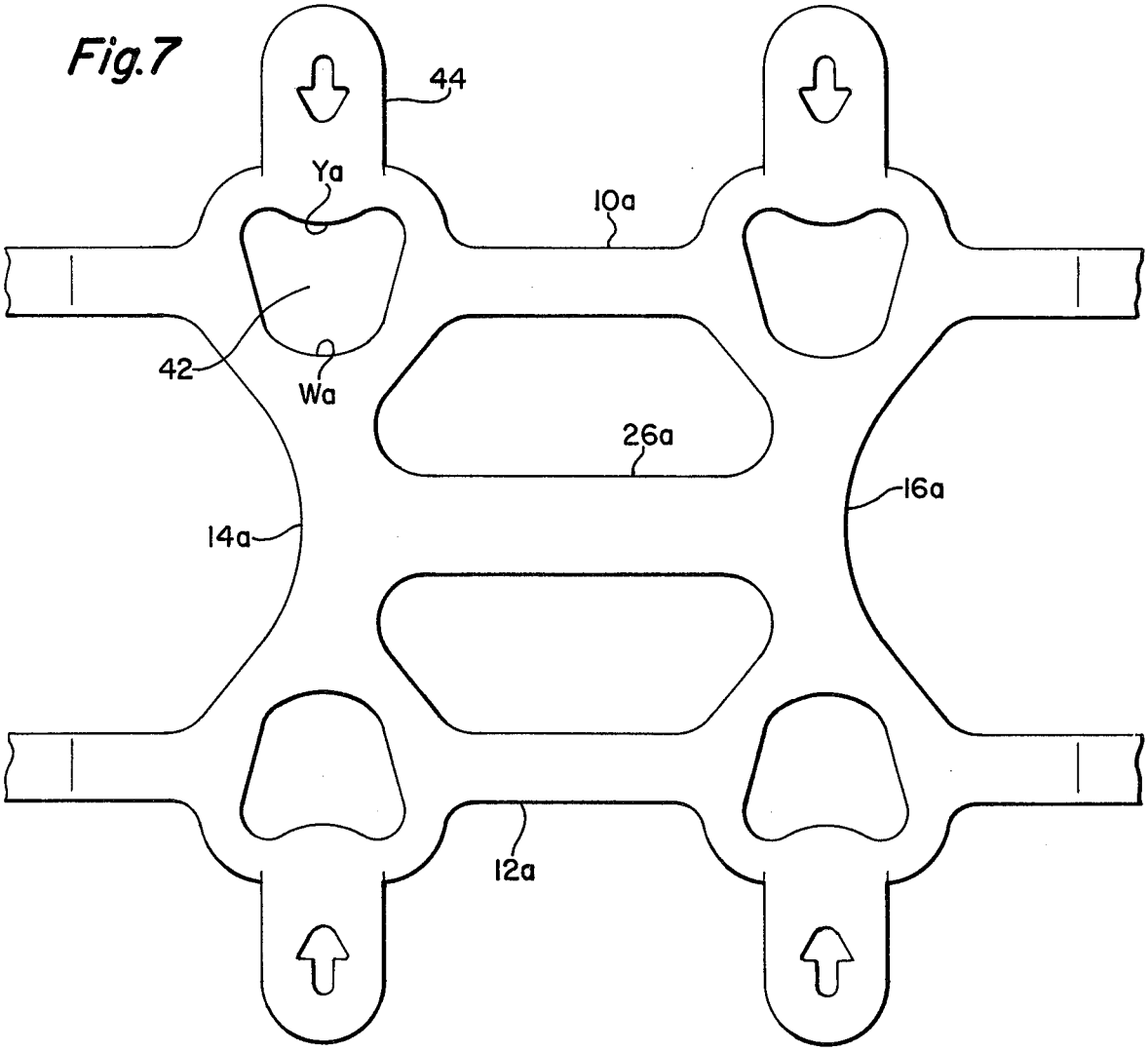
FIG. 7 is a plan view of a carrier blank for a four or six pack with modified shape of neck receiving openings.
Figure 8:
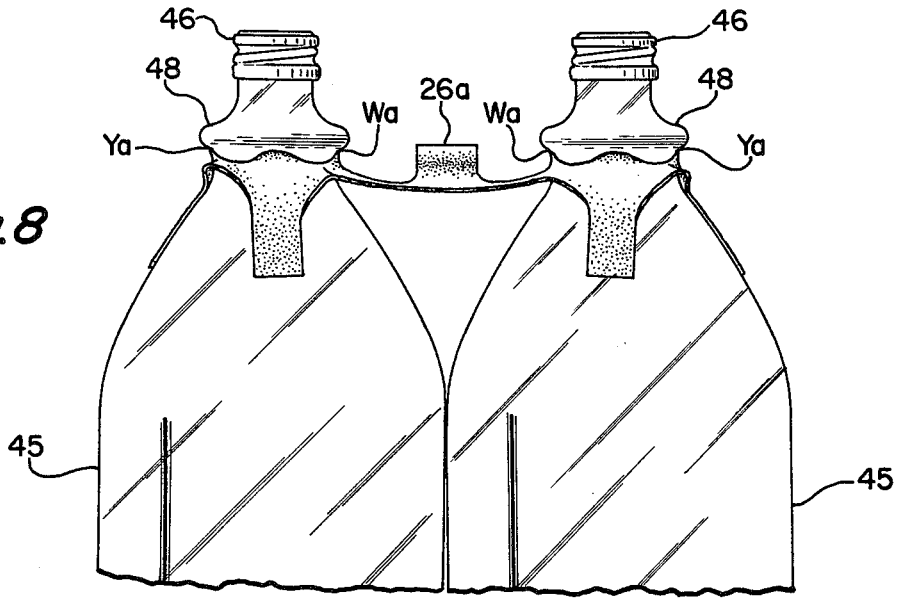
FIG. 8 is an end view of the carrier associated with bottles in parallel rows.
Figure 9:
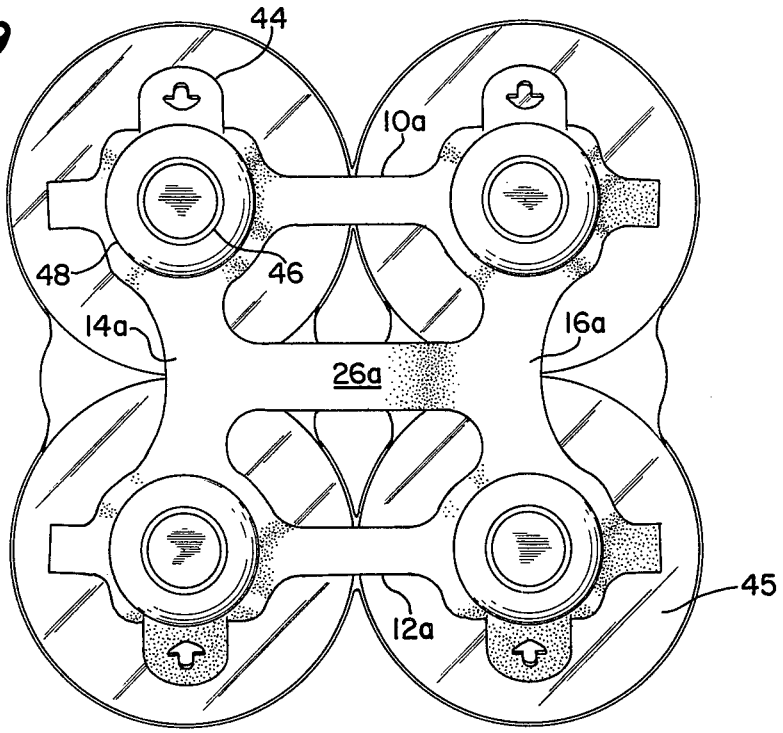
FIG. 9 is a top plan view of FIG. 8.
Figure 10:
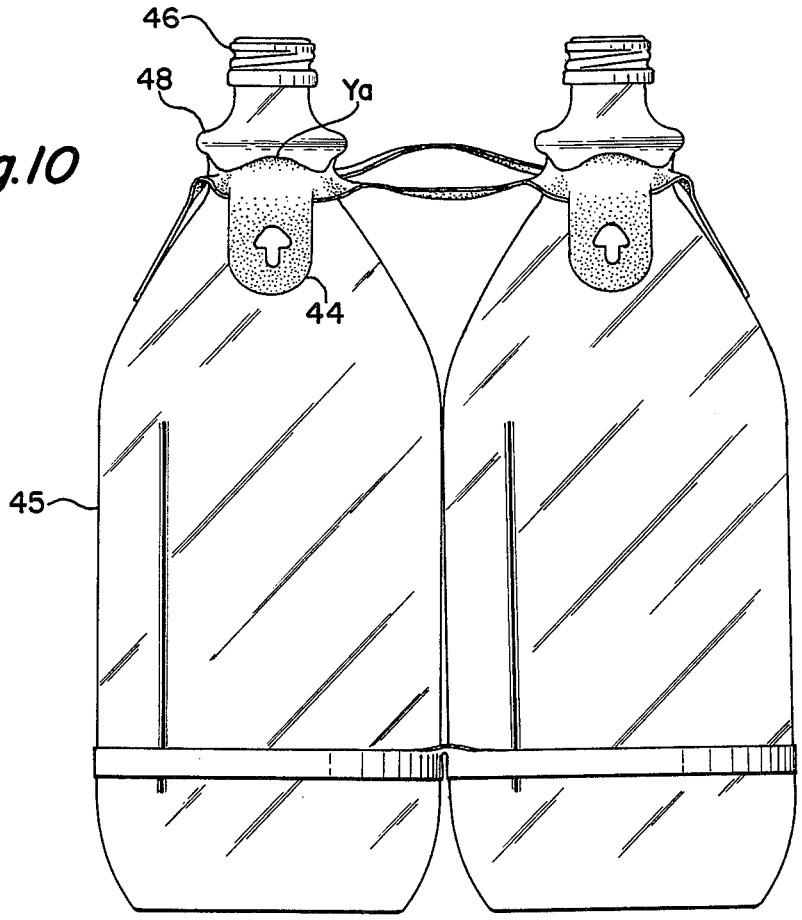
FIG. 10 is a side elevation of FIG. 9.

In the drawing modifications to be described below, like or substantially similar parts of the carrier sheet will be referred to by similar suffixed numerals, and the apertures and tab configurations will be separately numeraled. Thus, in FIG. 7, the apertures 42 with the band portions of the carrier material are somewhat frustoconical in plan appearance with the center portion of the elongate outer edge Y*a* somewhat rounded inwardly as a convex edge and the opposite shorter edge W*a* somewhat concaved. The tabs 44 extend along the major portion of the length of the edge Y*a*, thus providing substantial carrier blank material in this area. When such a carrier is associated with bottles 45 of the type having a screw top closure 46 and a lower outward bead 48 (see FIGS. 7–10), the tabs 44 will anug the surface of the bottles below the beads 48 in general surface conformity therewith and the band portion material along the edge Y*a* stand up, so to speak, without substantial stretching, with the edge Y*a* abutting the under surface of an adjacent bead and conforming to the bottle surface, and with the remaining portions of the bands being stretched to underlie adjacent surfaces of the beads for supporting the array of bottles in package form.

Figure 11:
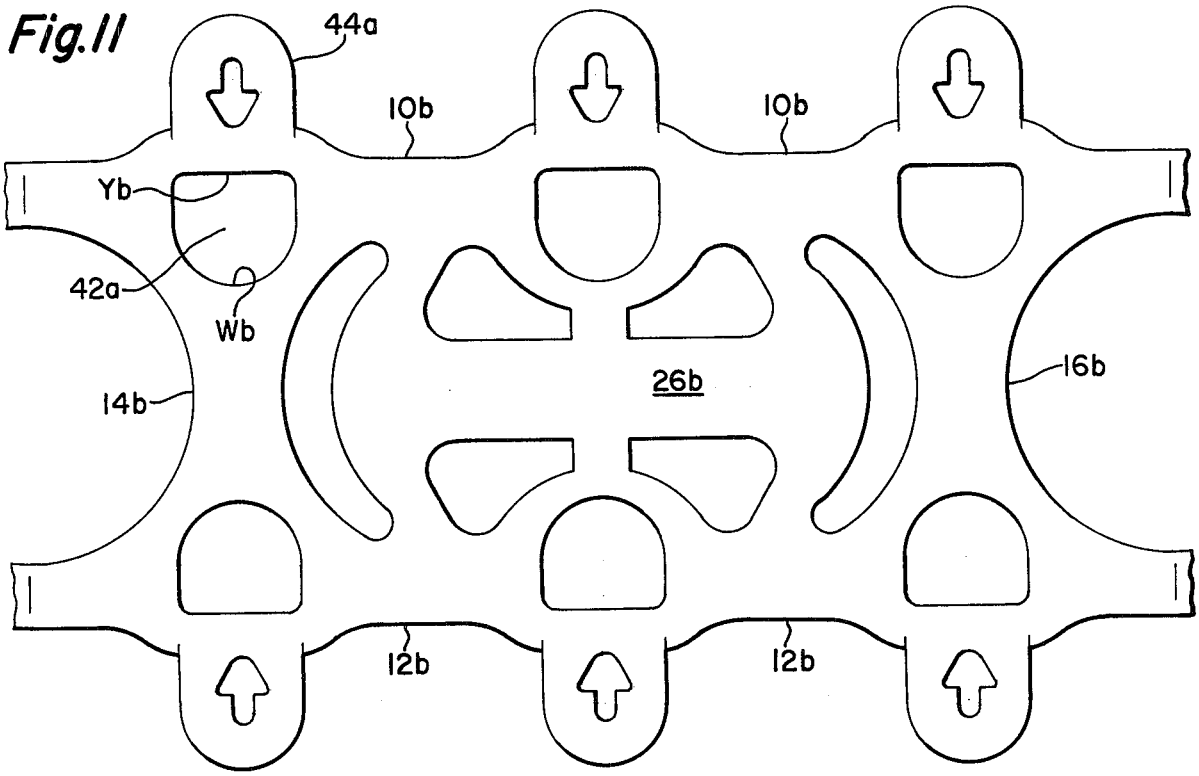
FIG. 11 is a plan view of a carrier blank with further modified shape of neck receiving openings.
Figure 12:
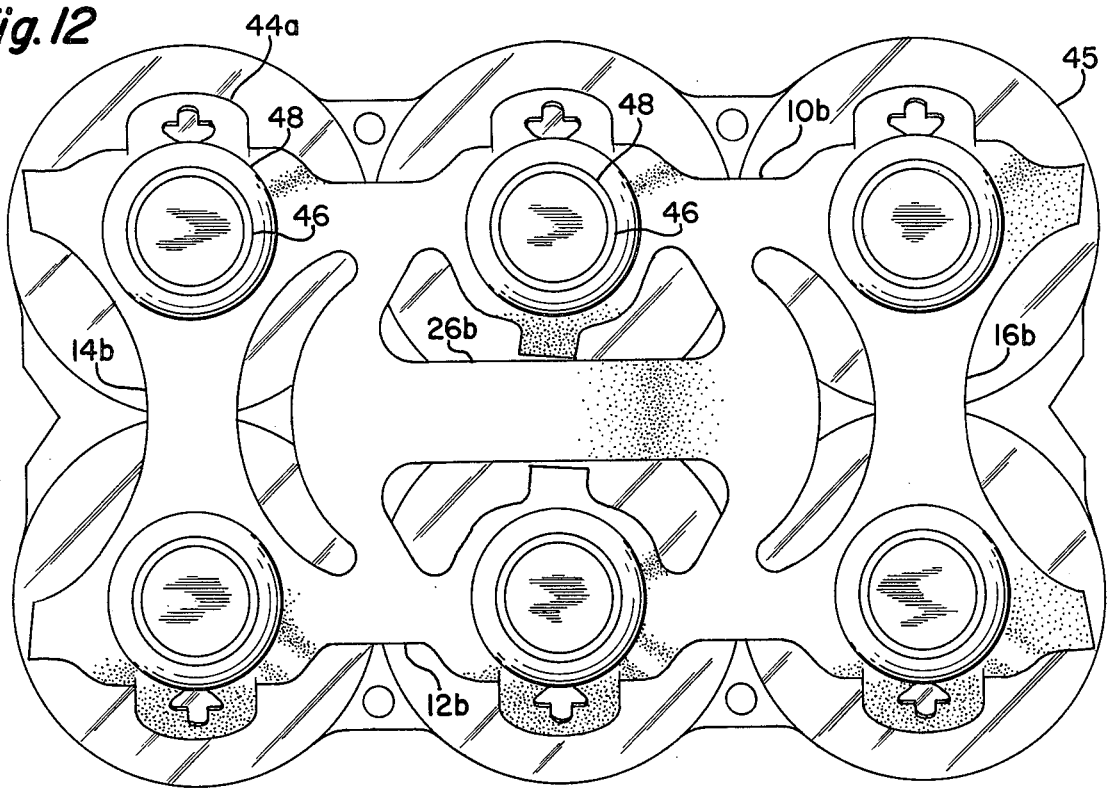
FIG. 12 is a top plan view of the carrier of FIG. 11 in association with bottles in parallel rows.
Figure 13:
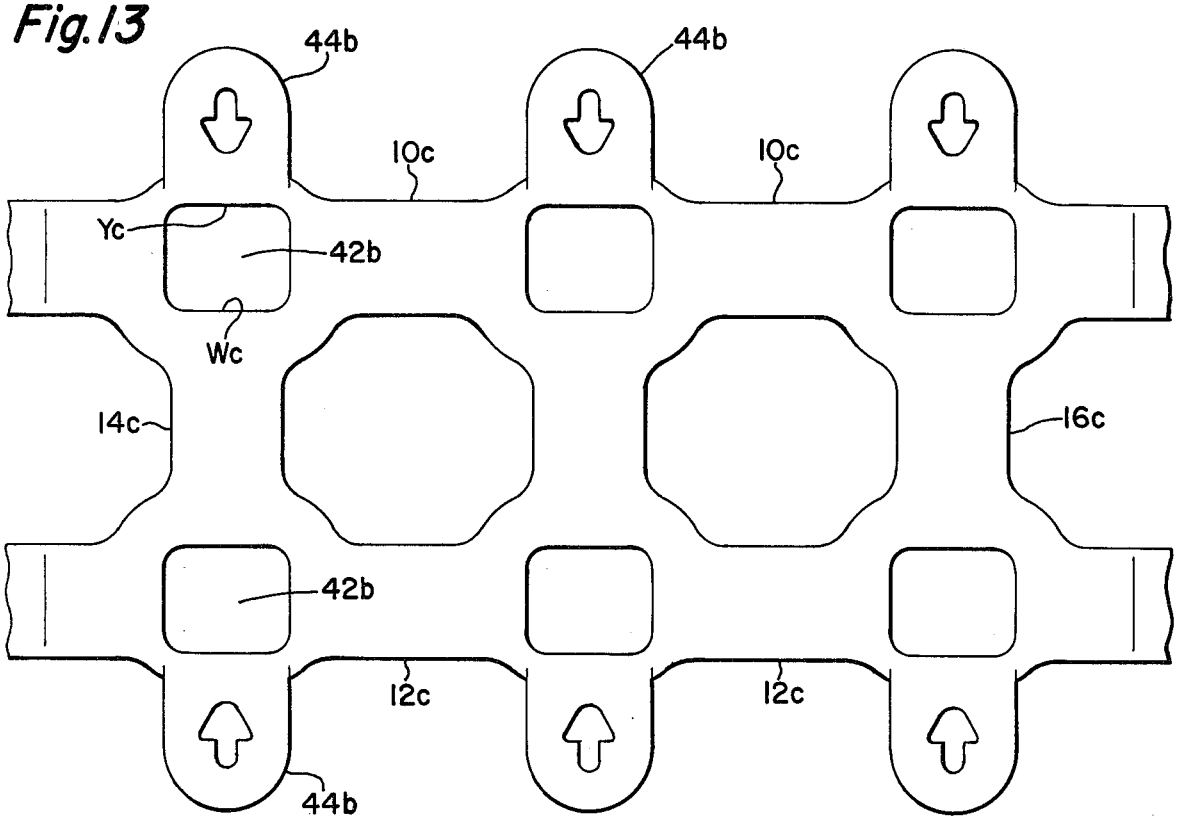
FIG. 13 is a plan view of a carrier blank with further modified shape of neck receiving openings.
Figure 14:
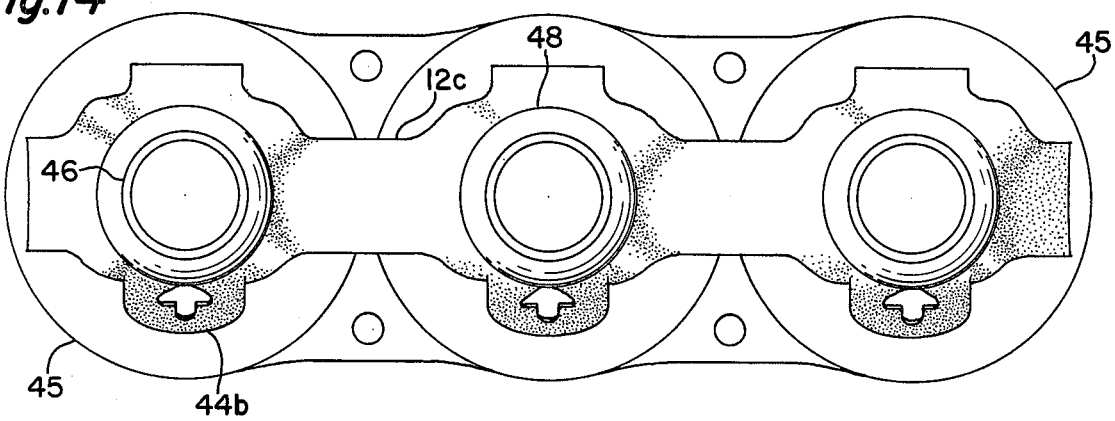
FIG. 14 is a top plan view of a single strip carrier for a single row of bottles.
Figure 15:
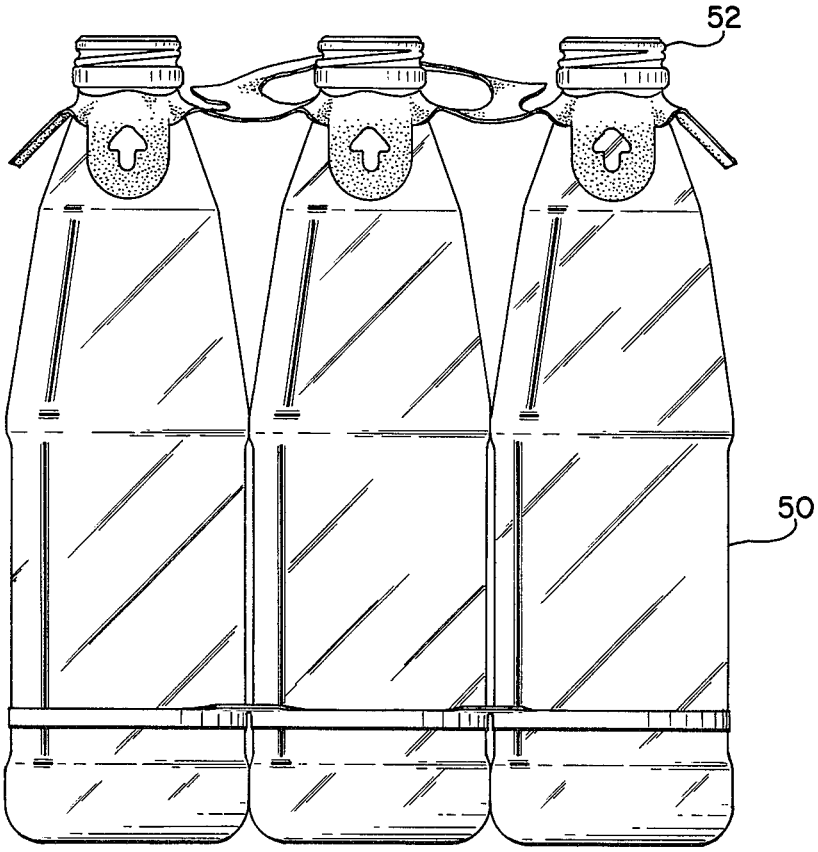
FIGS. 15 and 16 are side and end elevations, respectively, showing screw-capped bottles, as a six pack, in association with one of the carrier blanks.
Figure 16:
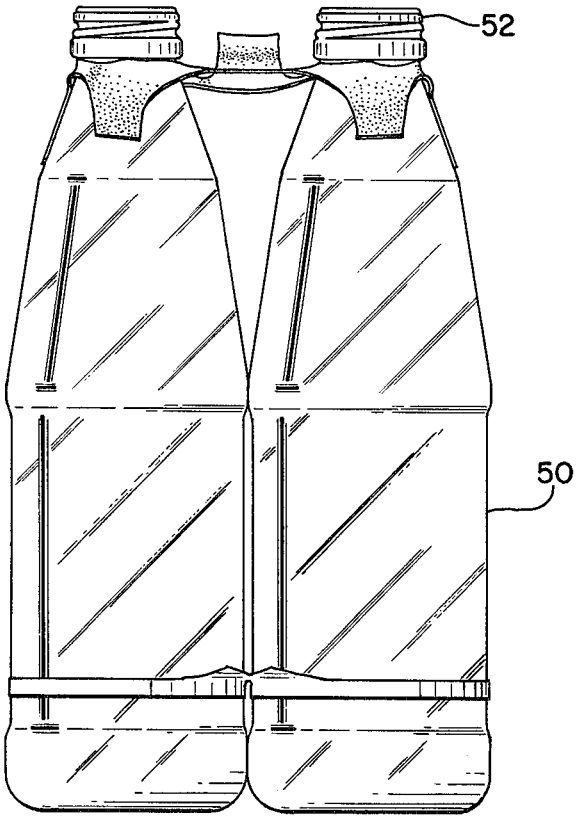

In FIG. 11, the apertures 42*a* within the carrier band portions have a substantially straight outer edge Y*b* and an opposite concave edge W*b* joined by parallel side edges. Here, the tabs 44*a* extend substantially along the entire length of the edges Y*b*. This carrier is associated with the packaged bottles in the same fashion shown in FIGS. 8 and 10 with the edges Y*b* engaged beneath the beads 48 and conforming to the adjacent bottle surface configuration, as do the tabs 44*a*. The remaining portions of the aperture edges are stretched to also engage beneath the beads in bottle supporting positions. In FIG. 13, the apertures 42*b* are substantially rectangular or square with rounded corners to resist tearing. Here, too, the width of the tabs 44*b* is substantially coextensive with the length of the outer edges Y*c* of the band portions and these outer edges will extend and underlie the beads 48 on the bottles as indicated in connection with FIGS. 8, 10 and 12, that is, with minimum stretching in this area. FIG. 14 illustrates a single strip carrier in association with bottles of the type shown in FIGS. 8, 10 and 12. FIGS. 15 and 16 illustrate a package of more slender bottles 50 with neck portions tapering upwardly and inwardly to the finish which may have screw caps 52 applied thereto.

What is claimed is:

1. A package of closely spaced containers each of the type having a reduced generally cylindrical neck portion with outward shoulder means below the dispensing opening: and a carrier sheet of resilient deformable plastic material with apertures spaced in accordance with the number and spacing of the packaged containers and providing encircling bands receiving the neck portions of corresponding containers with edge portions of the apertures deflected upwardly and engaged beneath the shoulder means of included containers; each aperture having at least one portion of the periphery thereof of substantial length generally approaching a straight line and at least approximating the maximum length of an included aperture; the material of the carrier sheet adjacent said one portion of the periphery of each aperture extending transversely outwardly into a finger gripping tab including a base portion as part of the encircling band; each tab having a width along the base portion thereof substantially coextensively spanning said one portion of the periphery of an adjacent aperture and an outwardly extending length dimension from said base portion relative to other portions of the carrier sheet material making up the encircling bands surrounding each aperture such as to provide increased transverse extent of material outwardly from said base portion for maximum resistance to stretching of each said one portion of the periphery of each aperture with a sharp downward deflection of each tab in external contiguous surface continuation of the upwardly deflected base portion against the neck portion of an adjacent container in the package of containers.

2. A carrier for rows of containers each of the type having a reduced neck portion presenting outward shoulder means adjacent the dispensing end thereof; and comprising a carrier sheet of resilient, deformable plastic material with apertures spaced in accordance with the number and spacing of the containers and providing encircling bands to receive the neck portions of the containers to be packaged; each aperture having at least one portion of the periphery thereof of substantial length generally approaching a straight line and at least approximating the maximum length of an included aperture; the material of the carrier sheet adjacent said one portion of the periphery of each aperture extending transversely outwardly into a finger gripping tab including a base portion as part of the encircling band; each tab having a width along the base portion thereof substantially coextensively spanning said one portion of the periphery of an adjacent aperture and an outwardly extending length dimension from said base portion relative to other portions of the carrier sheet material making up the encircling bands surrounding each aperture such as to provide increased transverse extent of material outwardly from said base portion for maximum resistance to stretching of each said one portion of the periphery of each aperture with a sharp downward deflection of each tab in external contiguous surface continuation of the upwardly deflected base portion against the neck portion of an adjacent container when the containers are assembled with the carrier in package form.

3. A carrier as claimed in claim 2, wherein each aperture is of generally elliptical configuration throughout the major peripheral extent thereof presenting a major axis lengthwise of the carrier sheet and terminating laterally outwardly thereof in said one portion of the periphery thereof.

4. A carrier as claimed in claim 2, wherein each aperture is generally rectangular with rounded corner portions.

5. A carrier as claimed in claim 2, wherein each aperture has an inwardly rounded inner edge.

6. A carrier as claimed in claim 2, wherein each aperture is of generally trapozoidal shape with the elongate edge providing the said one portion of the periphery thereof.

7. A carrier as claimed in claim 6, wherein the elongate edge is slightly curved inwardly.

8. A carrier as claimed in claim 7, wherein the inner edge of each aperture is curved inwardly of the carrier sheet.

* * * * *